US005437070A

United States Patent [19]

Rempp

[11] Patent Number: 5,437,070

[45] Date of Patent: Aug. 1, 1995

[54] MULTIPLE USE PILLOW

[76] Inventor: Carla Rempp, 1521 Shattuck, Berkeley, Calif. 94709

[21] Appl. No.: 17,706

[22] Filed: Jan. 15, 1993

[51] Int. Cl.[6] ..... A47G 9/02

[52] U.S. Cl. ..... 5/636; 5/640; 5/645

[58] Field of Search ..... 5/636, 637, 639, 640, 5/645

[56] References Cited

U.S. PATENT DOCUMENTS

| | | | |
|---|---|---|---|
| 247,892 | 10/1881 | Doremus | 5/640 |
| 1,385,355 | 7/1921 | Banks | 5/636 X |
| 3,327,330 | 6/1967 | McCullough | 5/640 |
| 3,416,169 | 12/1968 | Emery | 5/636 X |
| 3,604,026 | 9/1971 | Schelps | 5/640 X |
| 3,849,810 | 11/1974 | Degen | 5/645 X |
| 4,788,728 | 12/1988 | Lake | 5/636 |

*Primary Examiner*—Michael F. Trettel

[57] ABSTRACT

A star-like or flower shaped pillow and conforming pillowcase (24) comprised of cushioned extensions (14) radiating out from a center section (16) which create open portions or cavities between said sections. The resulting surface area is designed to provide support for various portions of epidermal tissue to rest on, thereby letting preferred areas remain free from pressure as said areas are suspended over the hollow spaces, thereby avoiding creasing and pressure on the skin.

3 Claims, 9 Drawing Sheets

MULTIPLE USE PILLOW

BACKGROUND—FIELD OF INVENTION

This field of invention relates to various pillows designed as aids in reducing sleep-induced creasing of the skin of the face and neck during sleep, and which also promote restful, comfortable sleep, thereby contributing to an overall promotion of healthy, beautiful skin.

BACKGROUND—DESCRIPTION OF PRIOR ART

Many pillows have been designed to aid in comfortable, supportive cushioning of the face and neck and which claim to minimize creasing of the delicate skin of the face and neck (thereby slowing/lessening the appearance of wrinkles).

Although many such pillow designs exist which may be suitable for some individuals, they fail to take into account or adapt to the variety of physical characteristics which exist (size and shape of physiognomy, as well as individual sleep styles/needs). Some are limited by their fixed, static shapes, being made out of foam in somewhat rigid forms. These appear rather orthopedic or clinical in appearance. Others fall under the category of "neck pillows" and provide special support of the neck, while others are comprised of certain coverings or contain certain fill materials which aid in limiting or reducing creasing of the skin. Many of these pillows attempt to aid in this purpose, but are somewhat limited in adapting to the naturally occurring movements of the individual during the course of sleep or rest.

OBJECTS AND ADVANTAGES

Accordingly, besides the objects and advantages of the various existing pillow designs presently available, several objects and advantages of the present design are:

a) to conform to a variety of positions needed in the course of resting or sleeping, due to both its resiliency and shape.

b) to provide a unique "cradling" support of the jawbone and side forehead area when sleeper is on his/her side, and to provide this automatically when sleeper turns from one side to the other during the course of sleeping;

c) to provide an open section within a supported area for those individuals recovering from various types of reconstructive and/or cosmetic surgery of the face. This is possible due to the petal sections which allow for the injured or recovering areas to remain free of surface pressure, as the petal "arms" will support the surrounding tissue only.

d) to adapt, due to the unique shape consisting of several "petal" sections surrounding a small pillow center, to the requirements of both yielding and supporting various parts of the face, head and neck during sleep, simultaneously providing support where needed and yielding or conforming where needed for those parts of the face, head and neck that come in contact with the "petals";

e) to provide an immediate surface area, due to its washable satin covering, which is conducive to not creasing delicate facial skin, thereby aiding in preventing wrinkles generated by repeated pressing of the face during sleep;

f) to provide a restful, comfortable shape for a variety of positions due in part to the fill material, which is a combination of any natural fibers commonly used as fill material in pillows, resin-treated polyester fiber, or, depending upon preference, 100% resin treated polyester fiber fill.

All of the above contribute to the promotion of a restful, relaxed state for reclining or sleeping. In addition, the pillow is ideally suited for:

i) traveling, as it can be used in automobiles, airplanes, etc., and its small size makes it convenient to pack.

ii) use by children, due to its flexible form and whimsical flower shape, iii) pregnant or nursing women, elderly, institutionalized patients or invalids, anyone requiring comfort and the added bonus of attractiveness in stressful times of illness, recovery, etc. It can be used as a decorative item aside from its practical use, being attractive when displayed on a bed, singly or in numbers, in a child's bedroom, etc.

iv) use in combination with other pillows, depending on the preference for thickness, cushioning etc.

v) use for providing cushioning of the lower limbs and back, feet, etc., not being limited to use only under the head and neck area.

DRAWING FIGURES

In the drawings, like designations refer to like parts throughout.

Figure 1:
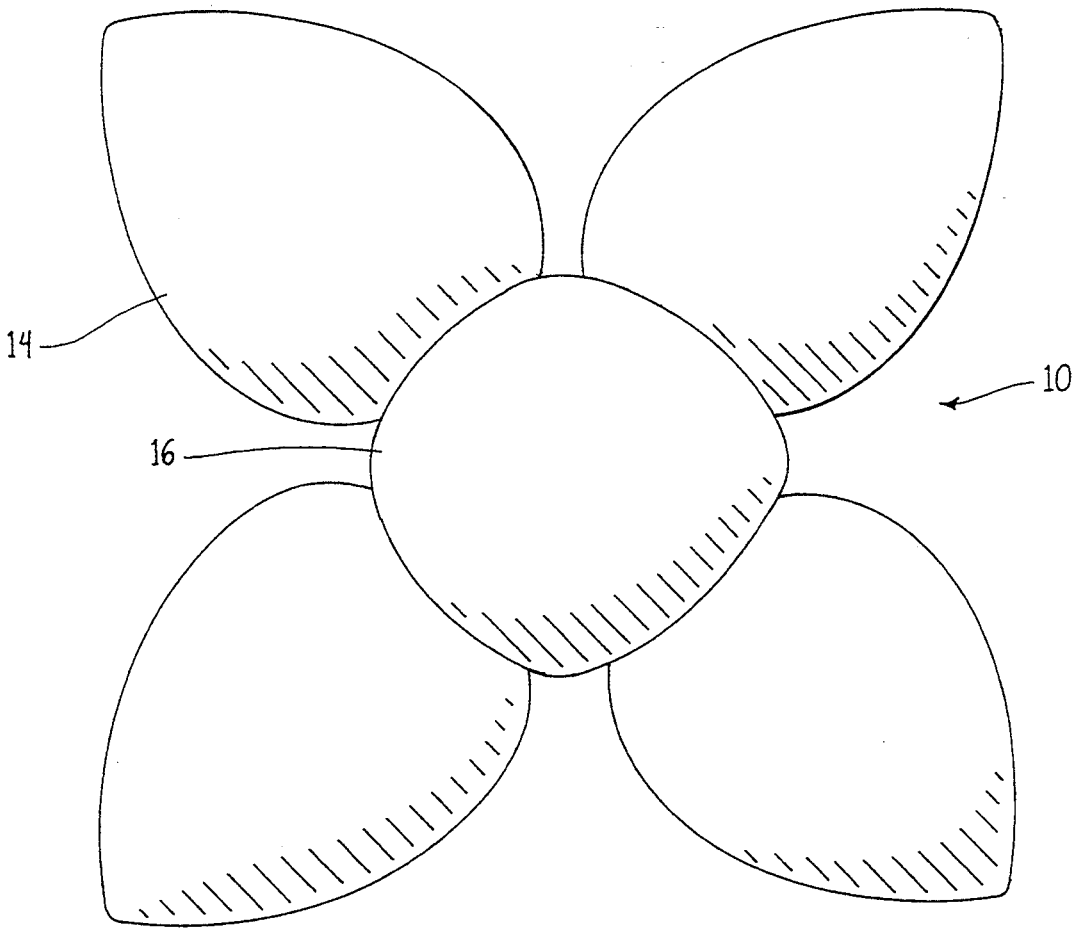
FIG. 1 is a pictorial view of the pillow as seen from the front.

| Reference Numerals in Drawings | |
|---|---|
| 10 | cotton outer covering of pillow |
| 12 | fill material (down, resin-treated polyester fiber, or any appropriate materials ordinarily used in pillows, with a firmer concentration of fill material in the petal sections and less density of fill material in the center section. |

-continued

| Reference Numerals in Drawings | |
|---|---|
| 14 | petals (with firmer support) |
| 16 | center section (softer support) |
| 18 | section fasteners, drawstrings, or the like, which are secured in place. |
| 20 | closure (zipper, VELCRO ® hook-and-loop, or other appropriate fastener) |
| 22 | closure flap |
| 24 | removable pillowcase |

DESCRIPTION—FIGS. 1 TO 7

Figure 2:
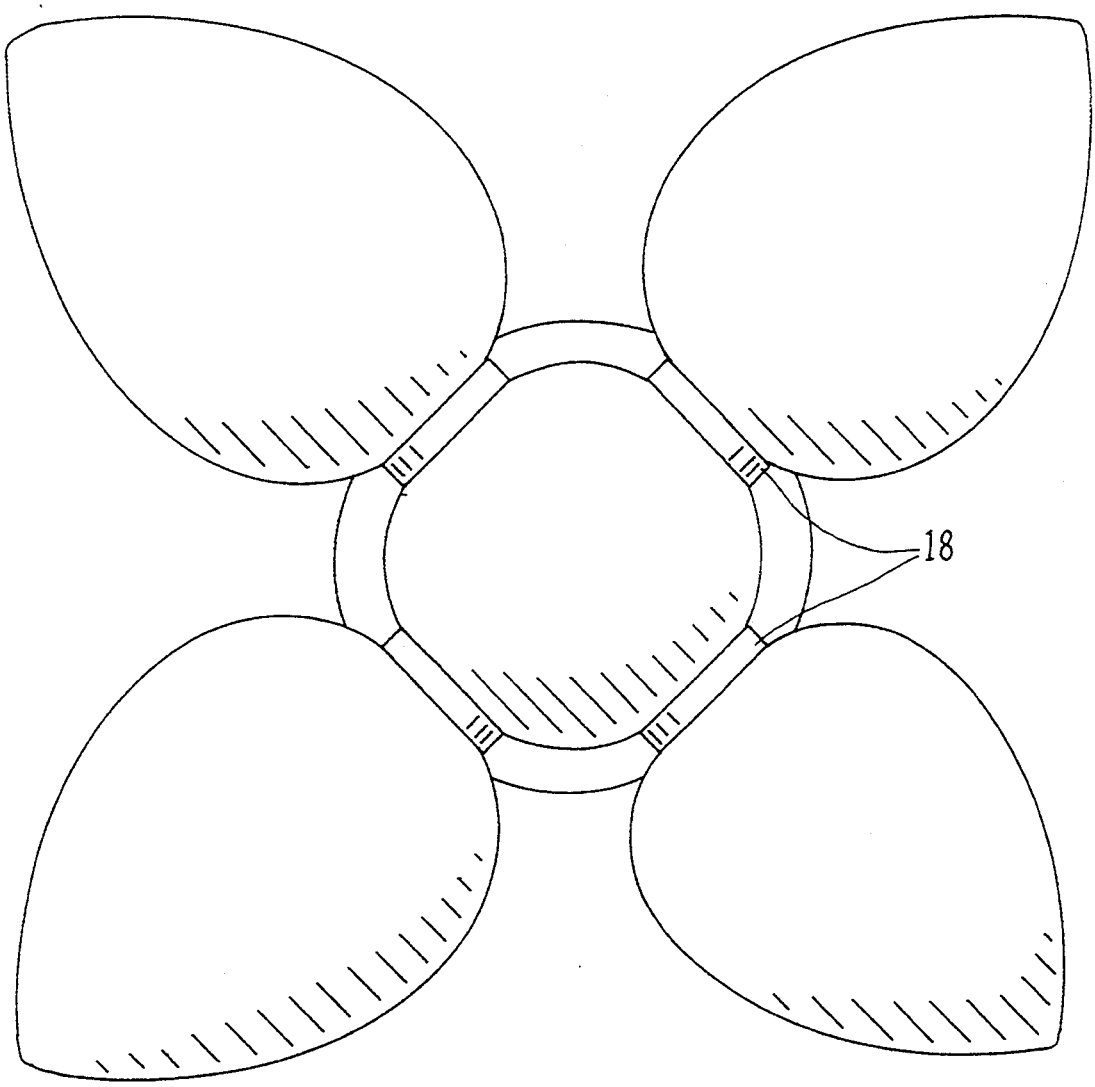
FIG. 2 is a pictorial view of the pillow as seen from the back.
Figure 3:
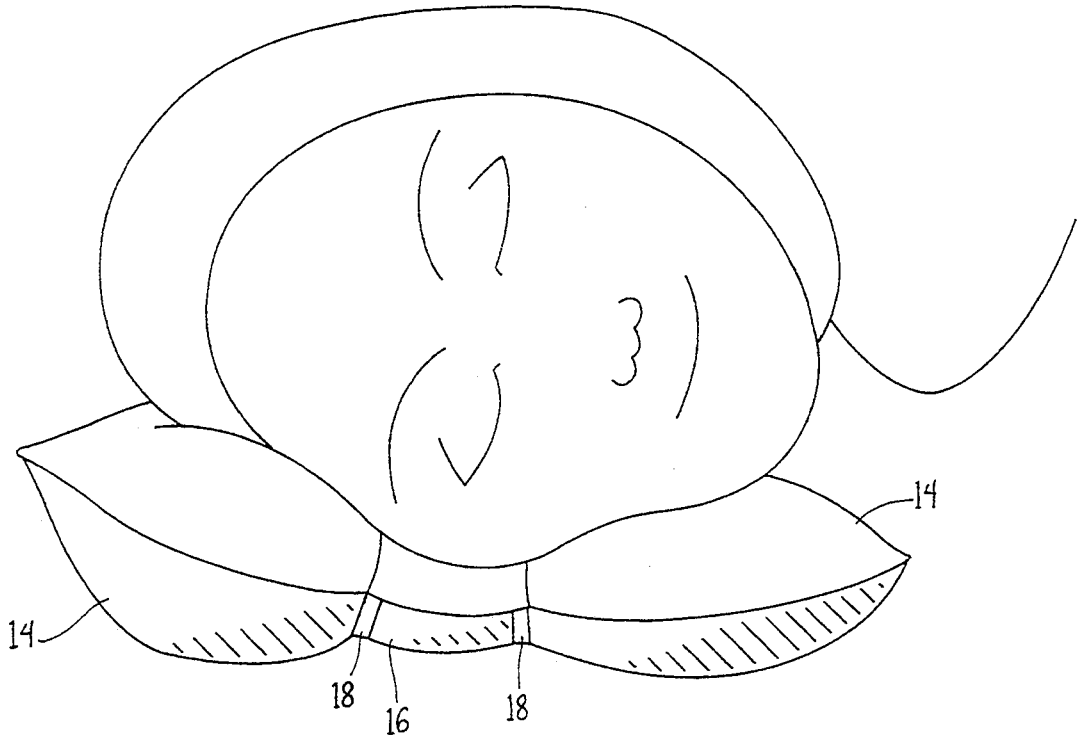
FIG. 3 shows a first preferred embodiment of the pillow, with a lateral view of a person lying on the pillow as it supports the jawbone and side of forehead.
Figure 4:
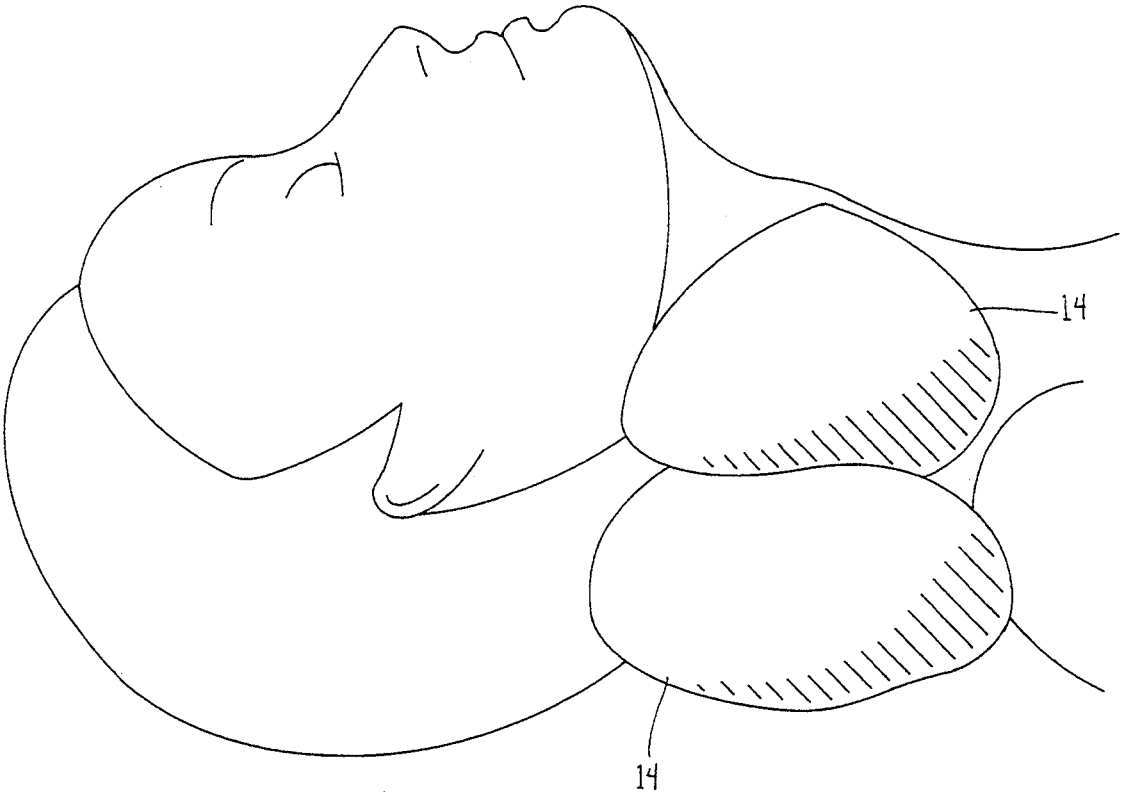
FIG. 4 shows a second preferred embodiment with the pillow used as a neck pillow, with a lateral view of a person lying on their back with the pillow (on its side) under the neck.
Figure 5:
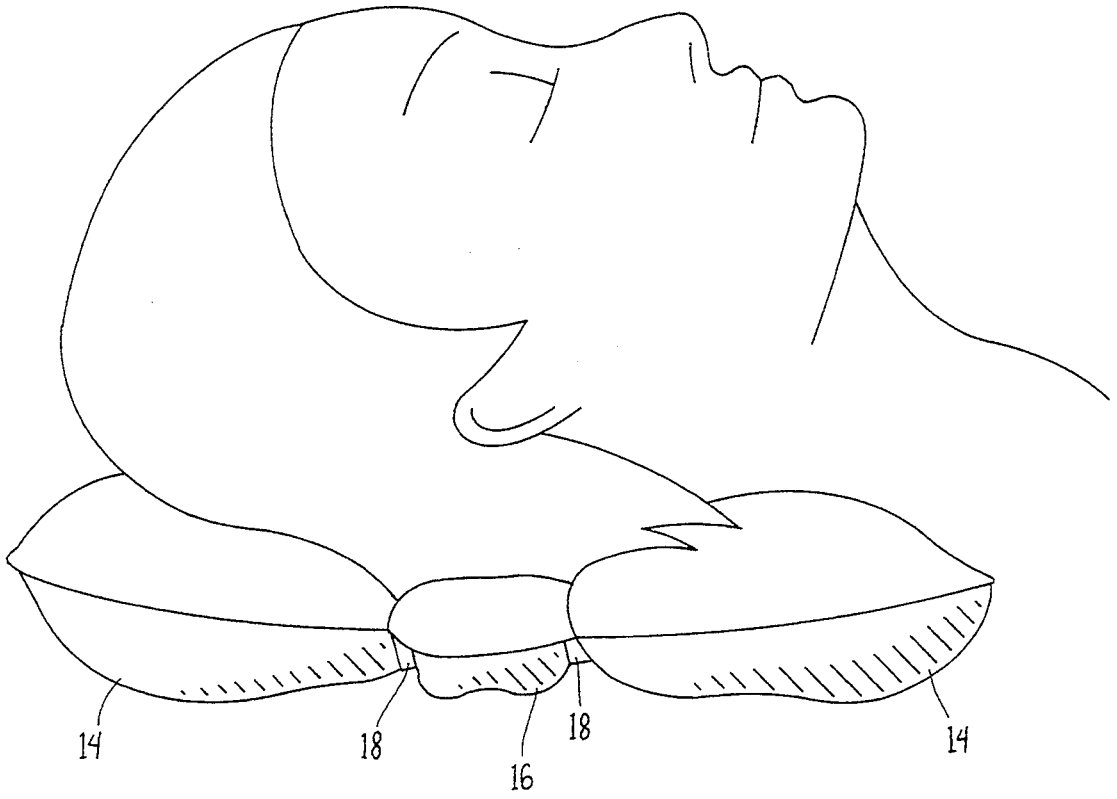
FIG. 5 shows a third preferred embodiment with the pillow lying flat, and the person lying on their back with the pillow creating a "nest" to cradle the head.
Figure 6:
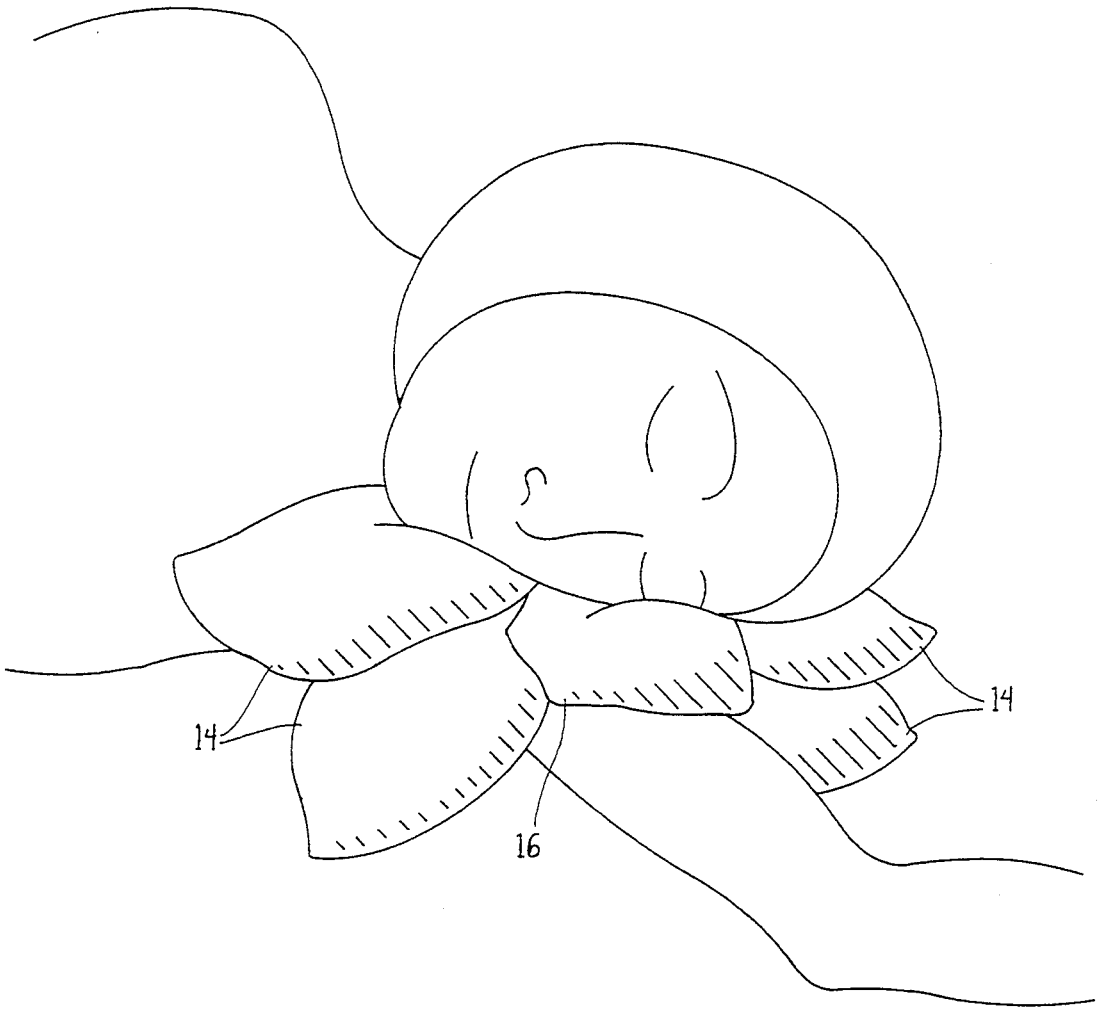
FIG. 6 shows a fourth preferred embodiment of the pillow, with the pillow placed on its side, so that there is additional thickness for cushioning the head, and a lateral view of the person reclining on one side, with one arm raised under the center section of the pillow.
Figure 7:
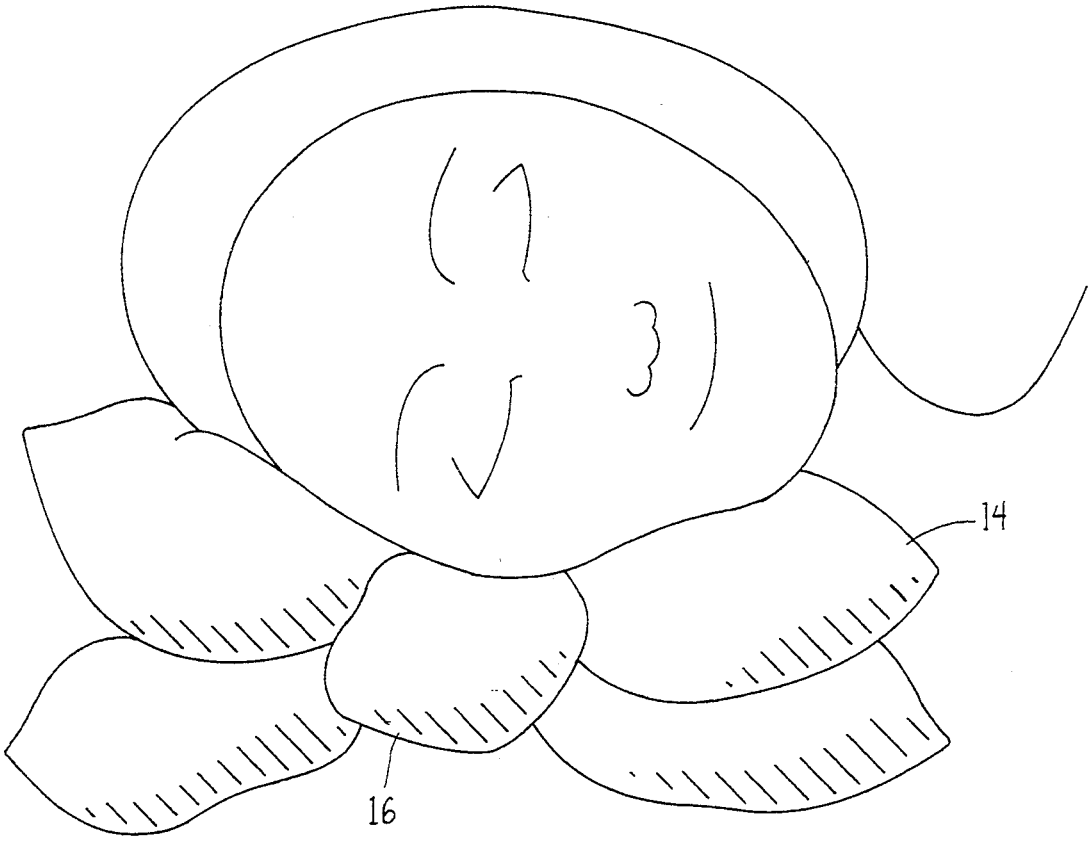
FIG. 7 shows another preferred embodiment of the pillow, with the pillow placed on its side for additional thickness, and the person reclining on one side with an arm behind the pillow, the face being supported by the petal sections.
Figure 8:
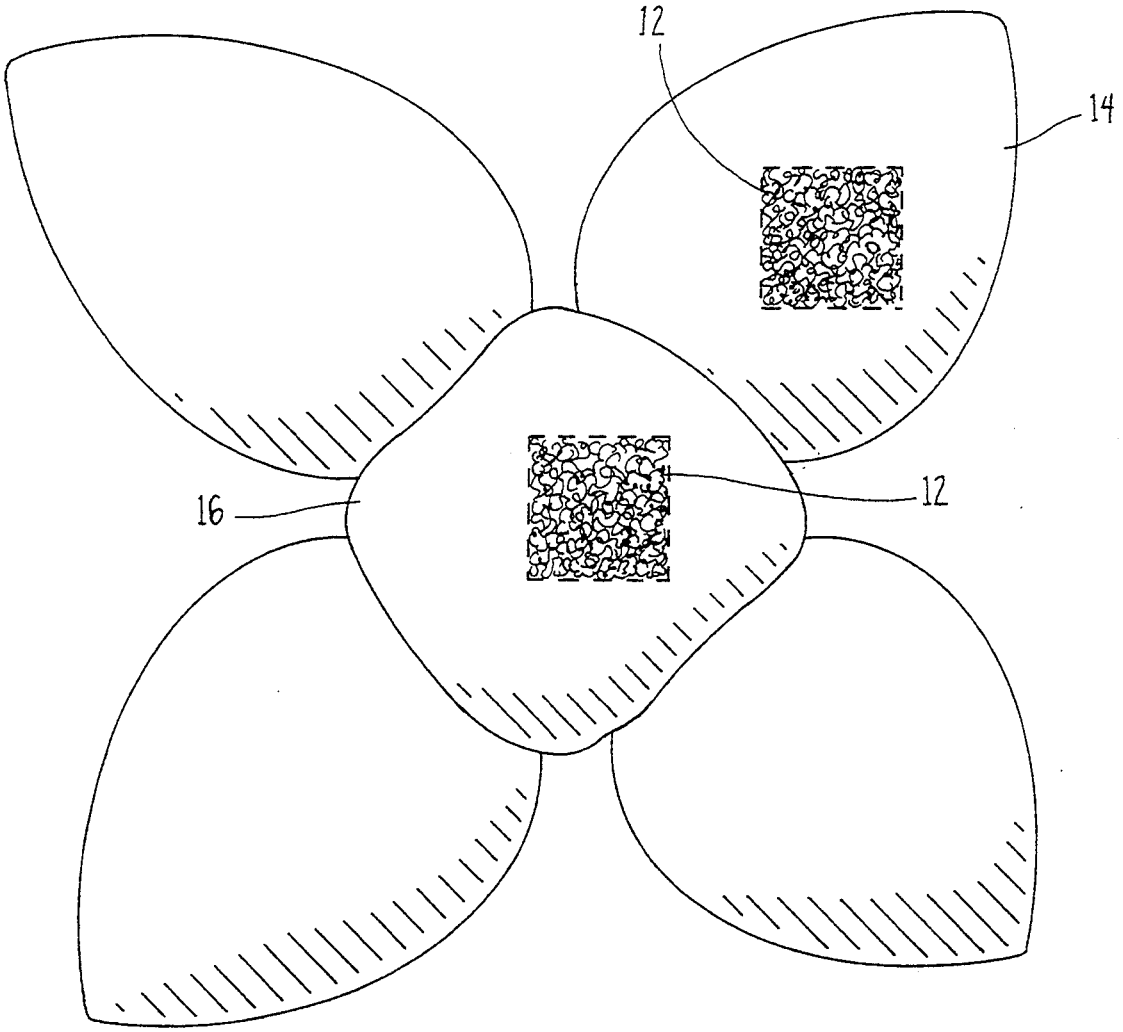
FIG. 8 shows a cross section of both the center and petal sections, indicating the fill material used in those sections.
Figure 9:
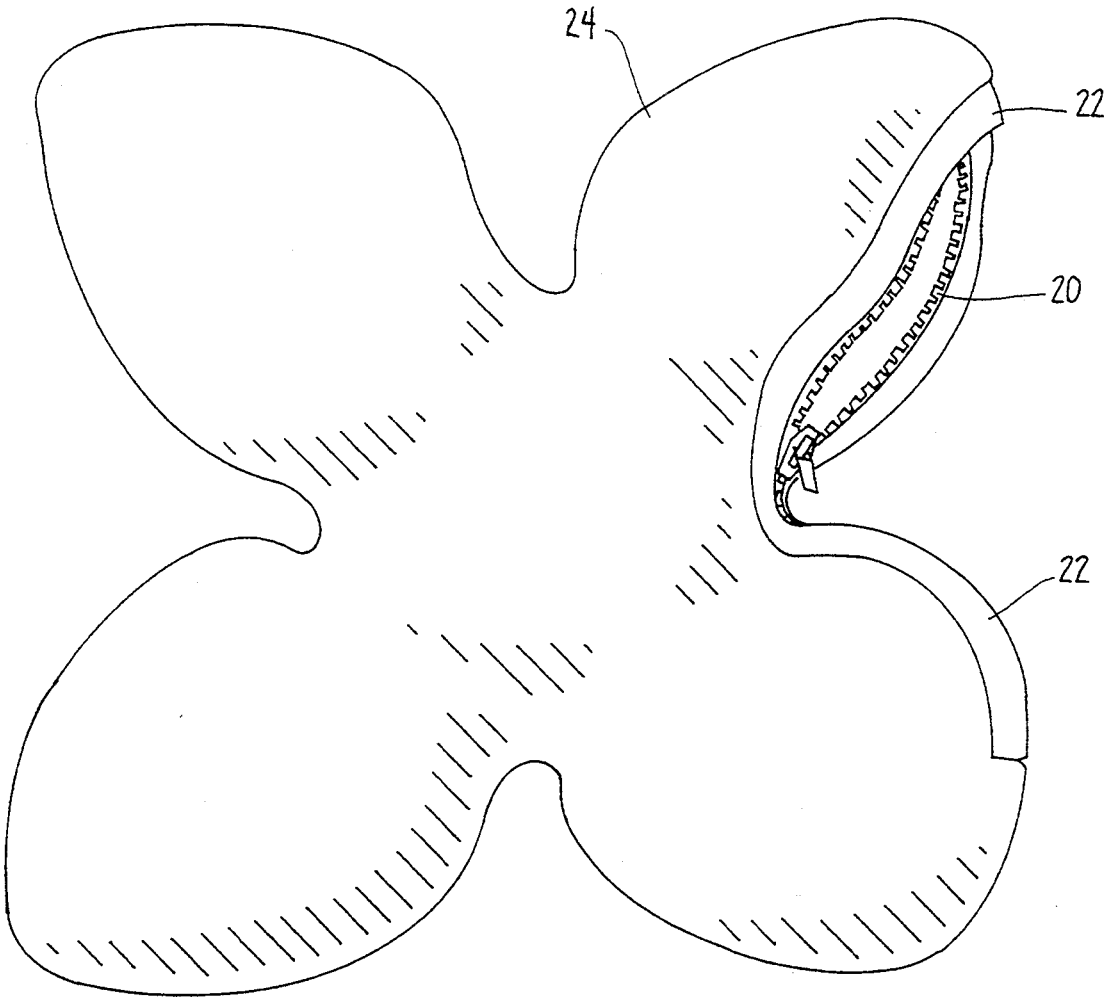
FIG. 9 is a view of the pillow as seen from the front, showing the washable satin (or the like) removable pillow case which has a nylon zipper (or other appropriate fasteners) on one side; said zipper is shown in a partially open position.

FIGS. 1 and 2 show the front and back of the pillow respectively. FIGS. 3 through 6 show typical embodiments of the pillow as follows: FIG. 3 shows how the pillow effectively cradles the head when the person is reclining on one side. The firmer support afforded by the petal sections support the side of forehead and chin/jawbone area, while the softer support of the middle section creates a "nest", while the delicate facial tissues are not pressed directly against any surface. FIG. 4 shows another embodiment; the person here is lying on their back, with the pillow, placed on its side, providing a support for the neck. FIG. 5 shows another embodiment; this with the person again on their back, the pillow this time is lying flat, creating a "nest" which effectively cradles the head. FIG. 6 shows the person lying on one side, with the pillow on its side, creating a thicker cushion for the head, 1 again the firmer petal sections coupled with the softer center section create a nest area which supports the head. FIG. 7 shows the pillow placed on one side and the person reclining on one side with one arm raised behind the pillow, the face being supported by the petals. FIG. 8 is a cross section of one of the petals of the pillow, showing the fill material used. This may be suited to the individual's preference; the pillow can either be filled with a blend of natural goose down and resin treated polyester fibers, or, should there be an allergy to natural fibers, or for any other reason, the fill material can be made with all synthetic fiber fill. FIG. 9 shows a view of the pillow as seen from the front, including its removable washable satin pillow case, shown with the zipper closure partially open.

SUMMARY, RAMIFICATIONS, AND SCOPE

A number of advantages can be seen, from the description above, of the pillow's superior usefulness in a variety of embodiments.

It embodies a unique shape, designed to cradle and support the body in a variety of ways.

It is small, malleable, and therefore ideally suited for travel and use in a variety of situations.

It is very pleasing and attractive, therefore making it ideal as a decorative object in addition to its usefulness.

It is suitable for use by pregnant or nursing women, elderly, children, institutionalized and/or convalescing patients or invalids, in short anyone requiring comfort with the added bonus of attractiveness.

It can be used in combination with other pillows, depending on the preference for thickness, color combinations, etc.

The removable, washable satin (or similar material) cover further enhances the qualities of the pillow which do not promote creasing of the skin during sleep, (which creasing leads to wrinkling of the facial skin). This removable case has been tailored to accommodate the contours of the pillow and contribute to its appearance as well as functionality.

Although the description above contains many specificities, these should not be construed as limiting the scope of the invention but as merely providing illustrations of some of the presently preferred embodiments of the pillow. For example, it can be used in a variety of other positions and ways, depending upon the preference of the user.

Thus the scope of the pillow should be determined by the appended claims and their legal equivalents, rather than by the examples given.

I claim:

1. A pillow comprising:

a) a central section having a plurality of petal sections radiating from said central section, forming recesses between any two adjacent said petal sections, said petal sections being spaced in relation to each other such that at least one recess formed is substantially opposite said central portion from another recess, said petal sections and said central section being of different resilience and;

b) said central section being small enough to fit between the side of a person's tilted head and shoulder region, allowing the head to be held by two petal sections, supporting the jaw line and temple, while the shoulder region is cradled in the opposite recess between adjacent petal sections, thereby preventing movement of the pillow.

2. A pillow comprising:

a) a central section having a plurality of petal sections radiating from said central section, forming recesses between any two adjacent said petal sections, said petal sections being spaced in relation to each other such that at least one recess formed is substantially opposite said central portion from another recess, and;

b) wherein said central section is small enough to fit between the side of a person's tilted head and shoulder region, allowing the head to be held by two petal sections, supporting the jaw line and temple, while the shoulder region is cradled in the opposite recess between adjacent petal sections, thereby preventing movement of the pillow, said pillow further including fill material selected from the group consisting of down, synthetic fiber fill and resin treated polyester fiber and resin treated polyester fiber fill.

3. A pillow comprising:

a) a central section having a plurality of petal sections radiating from said central section, forming recesses between any two adjacent said petal sections, said petal sections being spaced in relation to each other such that at least one recess formed is substantially opposite said central portion from another recess, said pillow including a covering made of fabric having a satin weave and;

b) wherein said central section is small enough to fit between the side of a person's tilted head and shoulder region, allowing the head to be held by two petal sections, supporting the jaw line and temple, while the shoulder region is cradled in the opposite recess between adjacent petal sections, thereby preventing movement of the pillow.

* * * * *